US006213084B1

(12) United States Patent
Jao

(10) Patent No.: US 6,213,084 B1
(45) Date of Patent: Apr. 10, 2001

(54) AUTOMOBILE ANTI-THEFT DEVICE

(75) Inventor: Shih-Hsu Jao, Chung-Ho (TW)

(73) Assignee: Happiness Wealth Brisk Ent. Co., Ltd., Taipei (TW)

( * ) Notice: Subject to any disclaimer, the term of this patent is extended or adjusted under 35 U.S.C. 154(b) by 0 days.

(21) Appl. No.: 09/545,507

(22) Filed: Apr. 7, 2000

(51) Int. Cl.[7] ..... F02B 77/00
(52) U.S. Cl. ..... 123/198 B; 251/129.03
(58) Field of Search ..... 123/198 B; 251/129.03, 251/129.15

(56) References Cited

U.S. PATENT DOCUMENTS 3,907,060 * 9/1975 Burton et al. ..... 123/198 B

* cited by examiner

*Primary Examiner*—Noah P. Kamen
(74) *Attorney, Agent, or Firm*—Dougherty & Troxell

(57) ABSTRACT

An automobile anti-theft device has a base (10), a connecting member (20), an activating member (30), an energizing device (40), a first connector (50), a second connector (60) and a bracket (70). The activating member (30) is able to be controlled by the energizing device (40) to block the fuel transmission so as to prevent any inappropriate operation to the engine.

2 Claims, 7 Drawing Sheets

AUTOMOBILE ANTI-THEFT DEVICE

BACKGROUND OF THE INVENTION

1. Field of the Invention

The invention relates to an automobile anti-theft device, and more particularly to a device that is able to shut the fuel pipe off when the energizer is not properly operated, such that the automobile is safely guarded from being stolen.

2. Prior Art Description

Normally, an existed car alarm is a combination of an electrical apparatus and a buzzer, which will sound the alarm when the car is not properly opened or initiated. However, this kind of car alarm will often give a false alarm by the influences such as environmental factor, a sudden vibration of air by a passing truck or even an impact of a ball. All these factors will affect the car alarm and thus the car owner will have to check on the situation of the car from time to time, which is quite troublesome especially in the late night. Furthermore, this kind of car alarm has delicate electrical circuit, which requires special person to mount it on the car and that somehow becomes a major reason of the battery failure or the entire circuitry of the car. Because the mounting of the car alarm will involve alteration to a major portion of the car circuitry, which not only affect the quality of the driving safety but also the life span of the battery. One other drawback is that if a car burglar damages the circuitry of the car alarm right after the burglar breaks into the car, the car alarm will not be able to sound an alarm to the owner.

To overcome the aforementioned problems, another type of car alarm is introduced to the market, which is able to shut the fuel pipe off when the car is not properly activated. However, due to the design defect, the fuel pump often is damaged and other related parts are also seriously affected.

Therefore, to thoroughly overcome the problems, the present invention introduced an improved automobile anti-theft device to obviate the aforementioned problems.

SUMMARY OF THE INVENTION

The primary objective of the present invention is to provide an automobile anti-theft device having a base (10), a connecting member (20), an activating member (30), an energizing device (40), a first connector (50), a second connector (60) and a bracket (70), with such an arrangement, the automobile is safely guarded.

Another objective of the invention is to provide an automobile anti-theft device, wherein the activating member (30) is able to allow a small amount of fuel to leak out to the fuel pipe, so that the fuel pump will not be damaged for not having any fuel in the fuel pipe.

Still, another objective of the invention is to provide an automobile anti-theft device, which is easy to be mounted on the automobile and needs not any alteration to the automobile circuitry.

Other objective of the invention will be clear after the detailed description of the package with the reference of the accompanying drawings.

BRIEF DESCRIPTION OF THE INVENTION

The present invention will be better understood with the description to the following drawings, wherein:

FIG. 7 is a schematic view showing a preferred embodiment of the invention.

DETAILED DESCRIPTION OF THE PREFERRED EMBODIMENT

Figure 1:
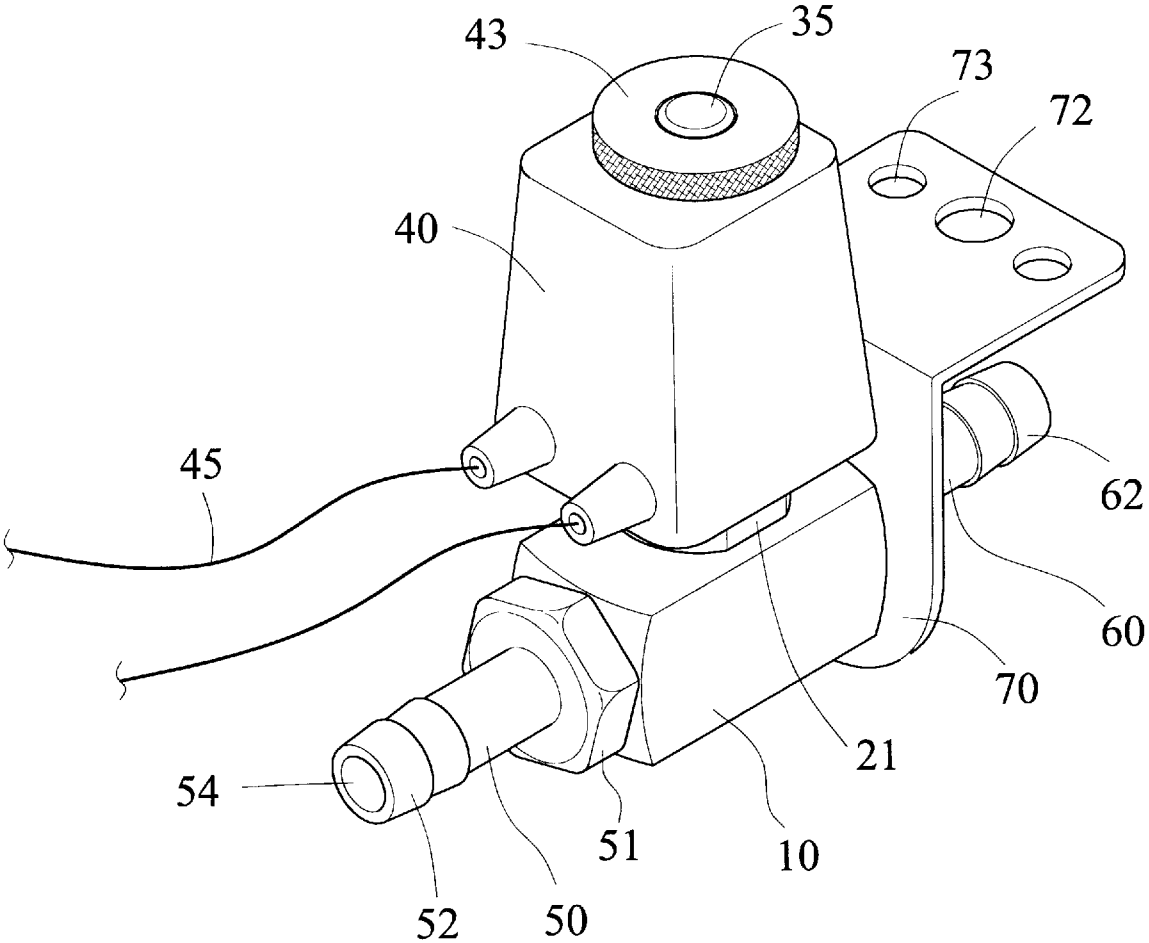
FIG. 1 is a perspective view showing the automobile anti-theft device in accordance with the present invention.
Figure 2:
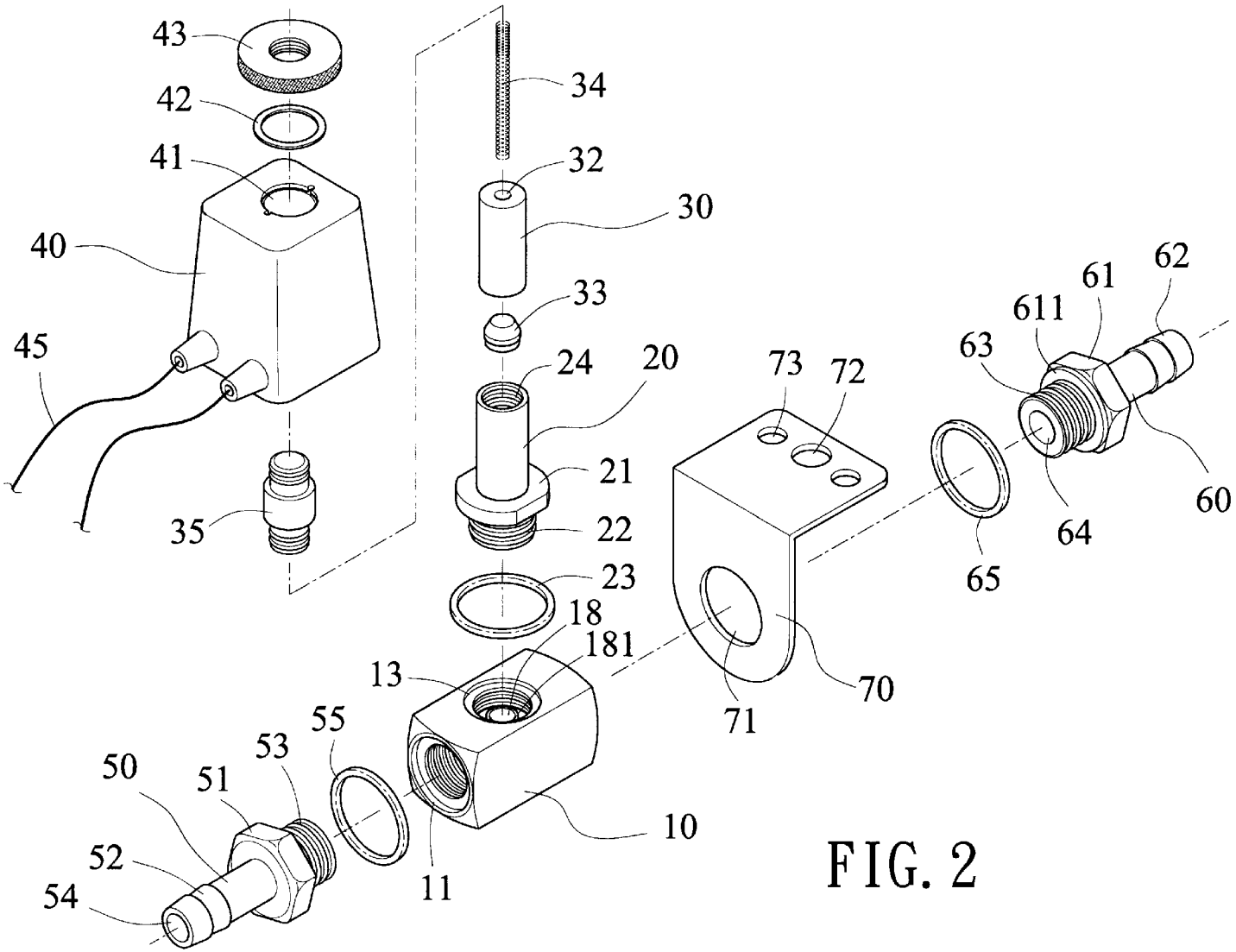
FIG. 2 is an exploded perspective view showing the parts of the device shown in FIG. 1.
Figure 3:
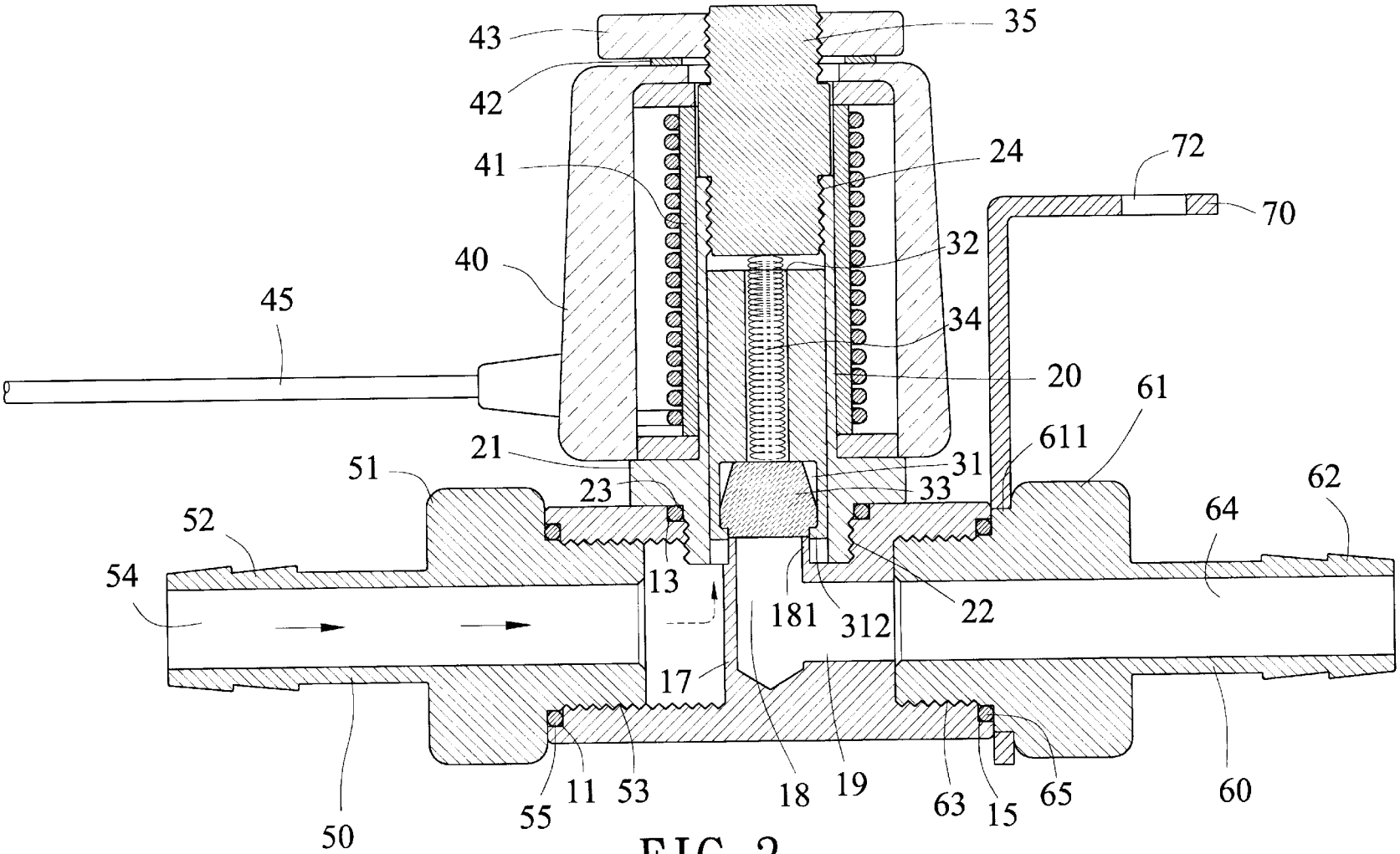
FIG. 3 is cross sectional view of the automobile anti-theft device taking the line 3—3 of FIG. 1.

With reference to FIGS. 1, 2 and 3, it is to be noted that the automobile anti-theft device in accordance with the present invention has a base (10), a connecting member (20), an activating member (30), an energizing device (40), a first connector (50), a second connector (60) and a bracket (70), with such an arrangement, the automobile is safely guarded.

Figure 4:
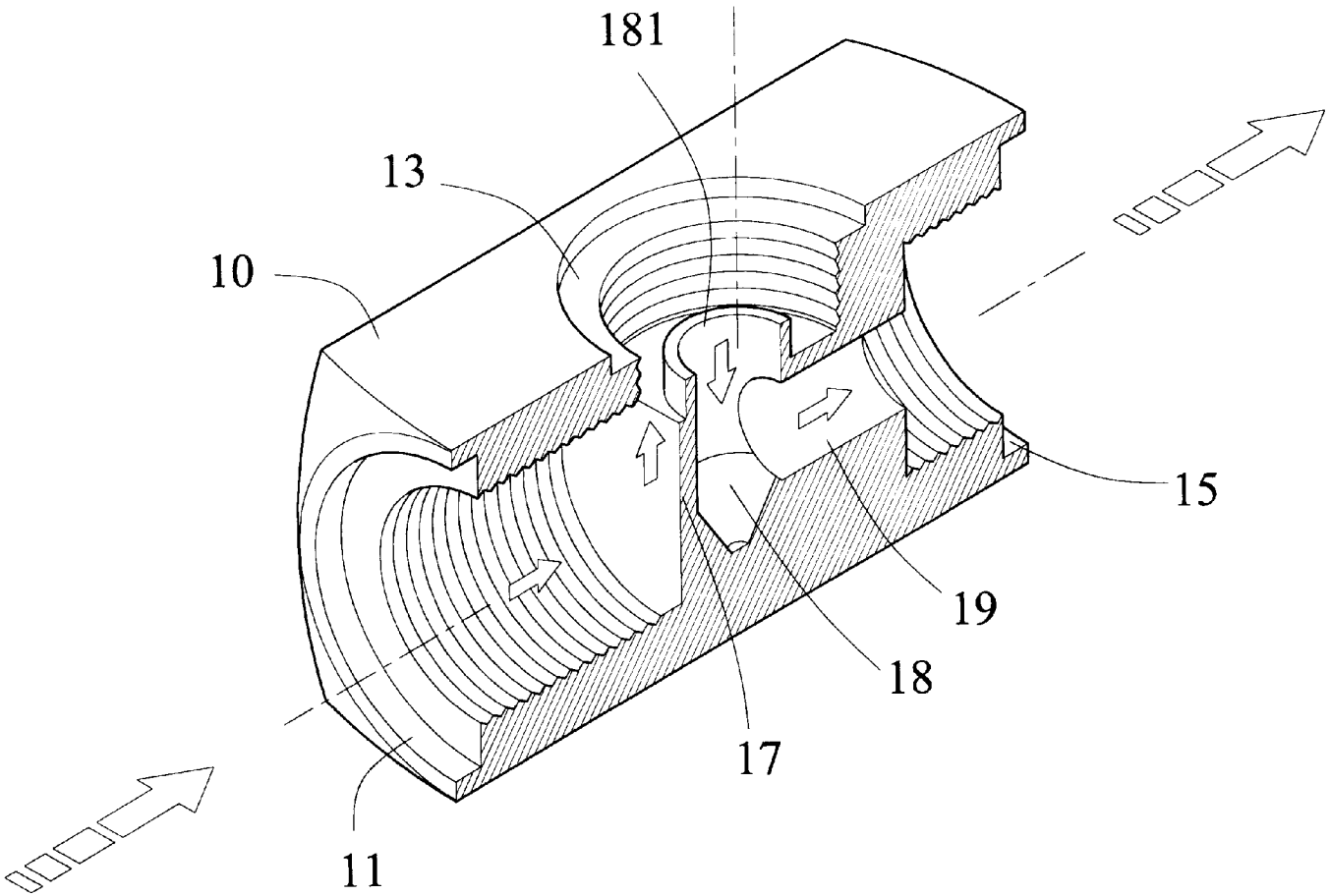
FIG. 4 is a perspective view of the base in partial section.

The base (10), taking FIG. 4 for reference, is a three-way structure and has a first threaded passage, a second threaded passage and a third threaded passage (11,13,15) each opening in a common direction so as to threadingly connected with the connecting member (20) and communicate with the activating member (30). The base (10) still has a vertical wall (17) formed therein, a hole (18) in communication with the second threaded passage (13), an annular ring (181) formed adjacent the wall (17) and having the hole (18) defined therein and a guiding path (19) defined to communicate with the hole (18) and the third threaded passage (15).

The connecting member (20) is a T-shaped tube such that the activating member (30) is able to be received therein. The connecting member (20) has a flange (21), a first end (22) which has outer threads formed to correspond to the second threaded passage (13), an oil ring (23) provided to be received on top of the second threaded passage (13) and a second end (24) with inner threads.

Figure 5:
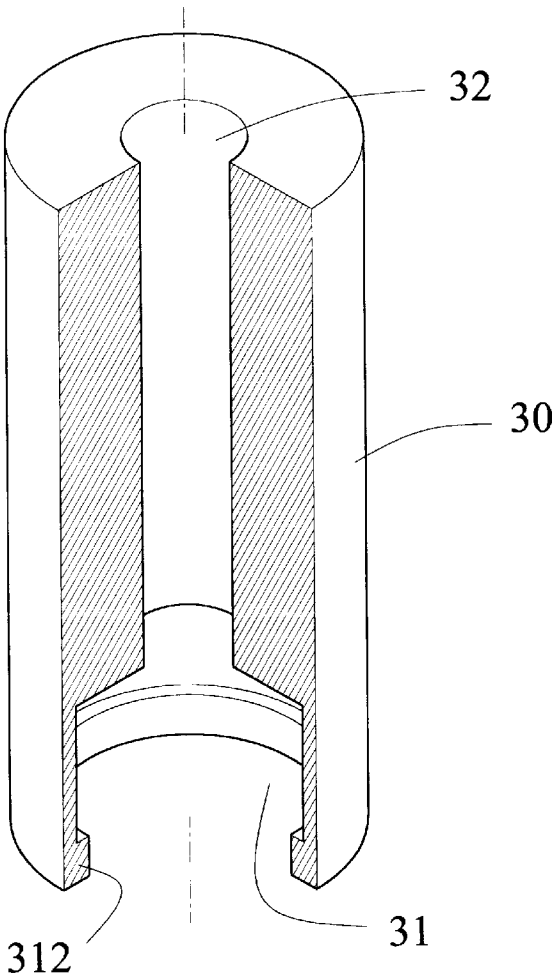
FIG. 5 is a perspective view of the activating member in partial section.

The activating member (30), taking FIG. 5 for reference, is a cylindrical tube that is received in the connecting member (20) and has a space (31) defined in a bottom thereof, a shoulder (312) formed to receive a plug (33), a through hole (32) defined to communicate with the space (31) for receiving therein a spring (34) and a connector (35) threadingly engaged with the second end (24) of the connecting member (20).

The energizer (40) has an induced magnet (41) to provide necessary magnetic force to control the movement of the plug (33) of the activating member (30), an annular ring (42) and a nut (43) which are provided to be threadingly engaged with the connector (35). The first connector (50) has a shoulder (51), a stepped end (52), a screw end (53) and a through hole (54). The stepped end (52) is provided to facilitate the engagement with an fuel pipe (not shown) and an oil ring (55) is seated on the screw end (53) and abutted the shoulder (51), such that when the screw end (53) is threadingly engaged with the base (10), the oil ring (55) is able to be received in the upper face of the first threaded passage (11) to prevent leakage.

The second connector (60) has a shoulder (61) with a flange (611) formed therewith, a stepped end (62), a screw end (63) and a through hole (64). The stepped end (62) is provided to facilitate the engagement with an fuel pipe (not shown) and an oil ring (65) is seated on the screw end (63)

and abutted the shoulder (61), such that when the screw end (63) is threadingly engaged with the base (10), the oil ring (65) is able to be received in the upper face of the third threaded passage (15) to prevent leakage.

The bracket (70) is an L-shaped frame with a first hole (71) defined to receive and secure the extension of the flange (611) of the shoulder (61) and multiple holes (72,73) defined to facilitate the mounting onto the body of the automobile.

With reference to FIG. 3, when the device of the invention is assembled and when the activating member (30) is not activated by the energizer (40), the plug (33) that is originally seated on top of the annular ring (181) to block the hole (18) still allows a little amount of fuel to flow through, which is still not enough to start the engine of the automobile but enough to protect the fuel pump (not shown) from damage.

Figure 6:
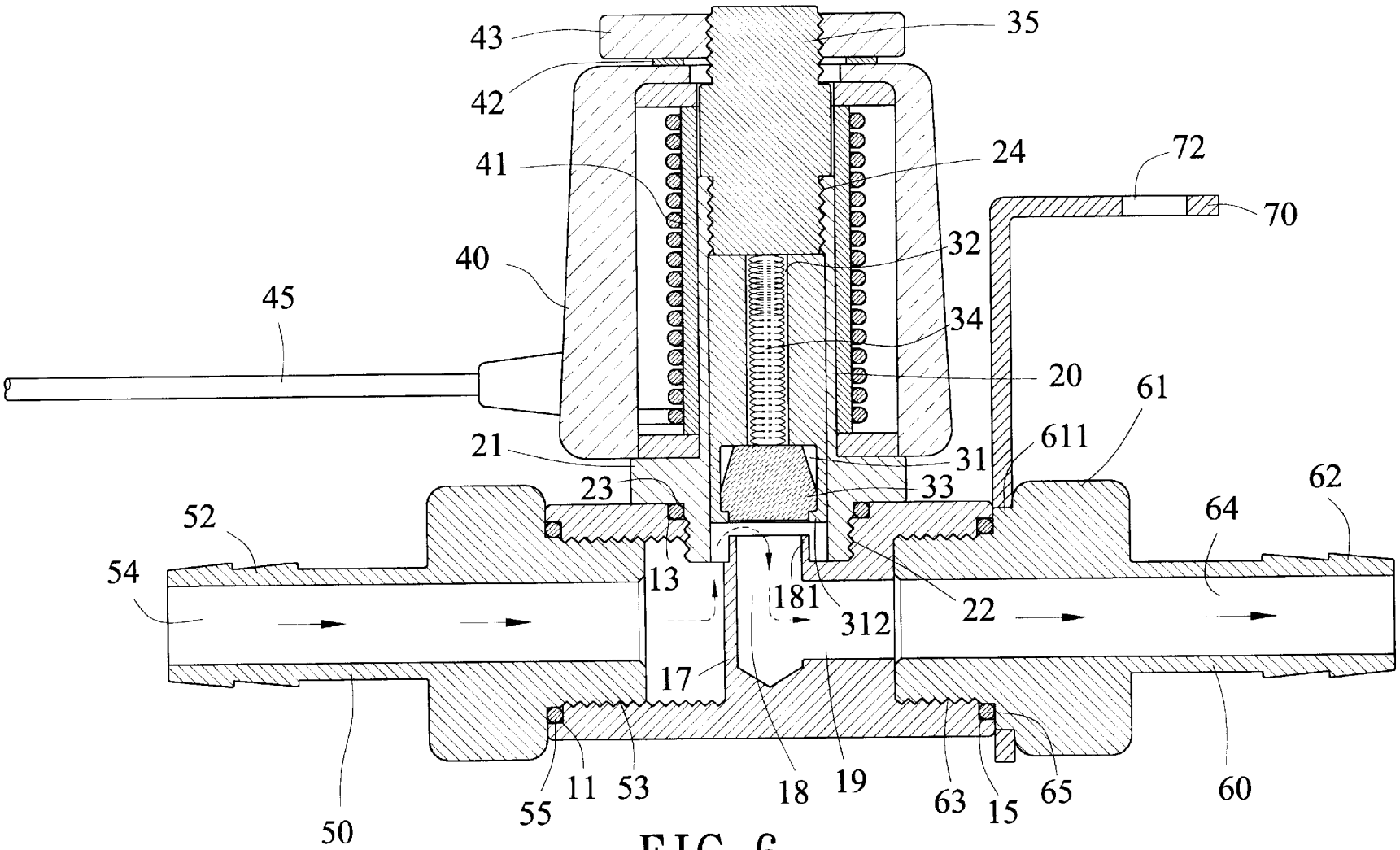
FIG. 6 is a schematic cross sectional view showing the function of the device in accordance with the present invention.
Figure 8:
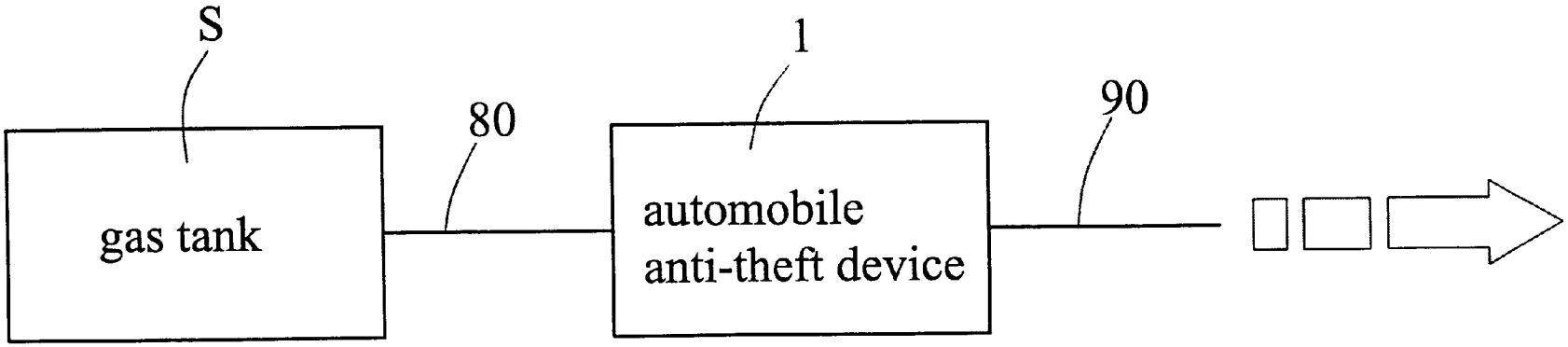
FIG. 8 is a chart showing the relationship between the device of the invention with the automobile.

Referring to FIG. 6, when the activating member (30) is activated by the energizer (40), that is, the induced magnet (41) is energized to attract the plug (33), the plug (33) will be moved away from the annular ring (181), thus, the fuel is able to flow over the wall (17), into the hole (18) and then flow out from the guiding path (19) to supply necessary fuel to the engine of the automobile. When the magnetic force of the induced magnet (41) vanishes, the spring (34) will then push back the plug (33) to its original position to continue block the annular ring (181) to stop fuel flow into the guiding path (19).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An automobile anti-theft device comprising:

a base (10) having a first threaded passage, a second threaded passage and a third threaded passage (11,13, 15) each opening in a common direction, a vertical wall (17) formed therein, a hole (18) in communication with the second threaded passage (13), an annular ring (181) formed adjacent the wall (17) and having the hole (18) defined therein and a guiding path (19) defined to communicate with the hole (18) and the third threaded passage (15);

a connecting member (20) having a flange (21), a first end (22) which has outer threads formed to correspond to the second threaded passage (13), an oil ring (23) provided to be received on top of the second threaded passage (13) so as to prevent leakage when the first end (22) threadingly engages with the second threaded passage (13) and a second end (24) with inner threads;

an activating member (30) received in the connecting member (20) and having a space (31) defined in a bottom thereof, a shoulder (312), a plug (33) movably received between the space (31) and the shoulder (312), a through hole (32) defined to communicate with the space (31) for receiving therein a spring (34) and a connector (35) threadingly engaged with the second end (24) of the connecting member (20);

an energizing device (40) having an induced magnet (41) to provide necessary magnetic force to control the movement of the plug (33) of the activating member (30), an annular ring (42) and a nut (43) which are provided to be threadingly engaged with the connector (35);

a first connector (50) having a shoulder (51), a stepped end (52), a screw end (53) corresponding to the first threaded passage (11) of the base (10) and a through hole (54), and an oil ring (55) seated on the screw end (53) and abutted the shoulder (51), such that when the screw end (53) is threadingly engaged with the base (10), the oil ring (55) is able to be received in the upper face of the first threaded passage (11) to prevent leakage;

a second connector (60) having a shoulder (61) with a flange (611) formed therewith, a stepped end (62), a screw end (63), a through hole (64) and an oil ring (65) seated on the screw end (63) and abutted the shoulder (61), such that when the screw end (63) is threadingly engaged with the base (10), the oil ring (65) is able to be received in the upper face of the third threaded passage (15) to prevent leakage;

a bracket (70) with a first hole (71) defined to receive and secure the extension of the flange (611) of the shoulder (61) and multiple holes (72,73) defined to facilitate the mounting onto the body of the automobile.

2. The device as claimed in claim 1, wherein the first connector (50) and the second connector (60) are identical.

* * * * *